US005384515A

United States Patent [19]

Head et al.

[11] Patent Number: 5,384,515

[45] Date of Patent: Jan. 24, 1995

[54] SHROUDED PIN ELECTRODE STRUCTURE FOR RF EXCITED GAS DISCHARGE LIGHT SOURCES

[75] Inventors: David A. Head, Beaverton, Oreg.; Robert D. Washburn, Malibu; Robert F. McClanahan, Valencia, both of Calif.

[73] Assignee: Hughes Aircraft Company, Los Angeles, Calif.

[21] Appl. No.: 970,741

[22] Filed: Nov. 2, 1992

[51] Int. Cl.[6] ..... H01J 65/04

[52] U.S. Cl. ..... 313/607; 313/234; 313/355; 313/613

[58] Field of Search ..... 313/573, 574, 492, 594, 313/607, 234, 355, 326, 601, 613, 635, 631; 315/248

[56] References Cited

U.S. PATENT DOCUMENTS

| | | | |
|---|---|---|---|
| 3,904,907 | 9/1975 | Young | 313/607 X |
| 4,024,431 | 5/1977 | Young | 313/607 X |
| 5,006,758 | 4/1991 | Gellert et al. | 313/607 X |
| 5,013,959 | 5/1991 | Kogelschatz | 313/607 X |

*Primary Examiner*—Donald J. Yusko
*Assistant Examiner*—Ashok Patel
*Attorney, Agent, or Firm*—L. A. Alkov; W. K. Denson-Low

[57] ABSTRACT

A shrouded pin electrode structure including an elongated pin that extends into the volume of a gas containment structure of an RF excited gas discharge light source and is physically isolated from the discharge gas contained in the volume of the gas containment structure by a shroud structure made for example of a gas impermeable dielectric coating or closed end tube.

7 Claims, 2 Drawing Sheets

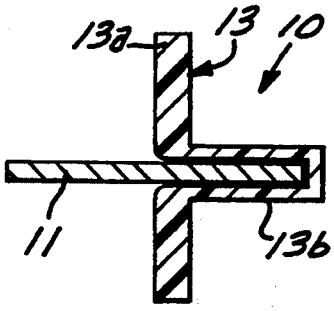
FIG. 1
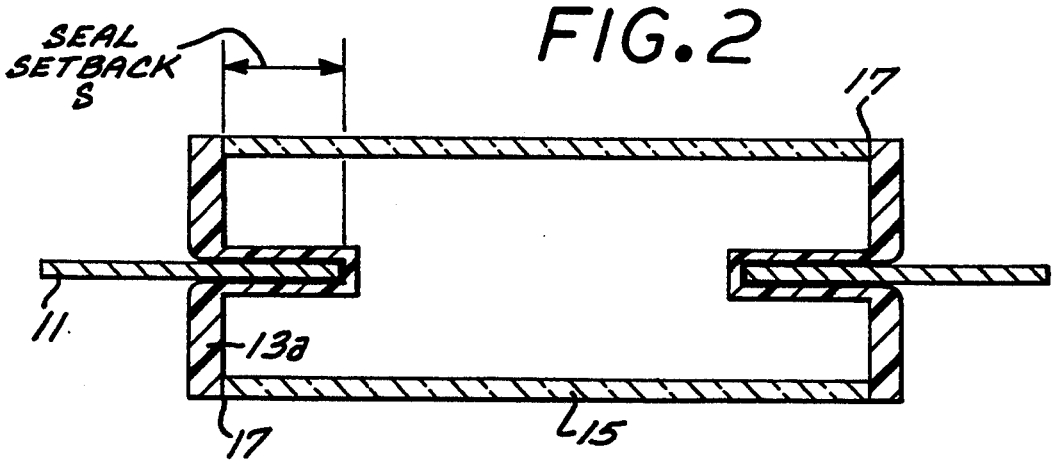
FIG. 2
FIG. 5
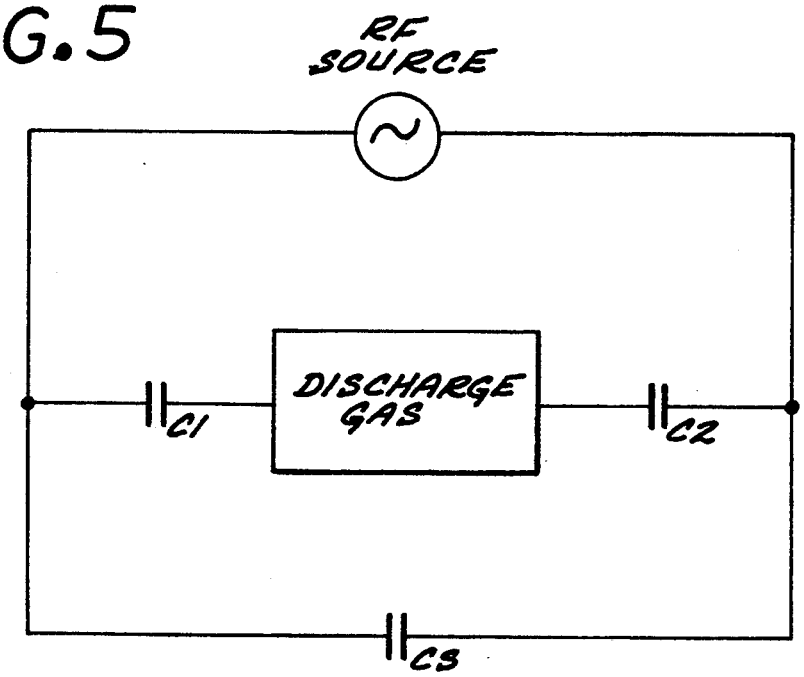

FIG. 3
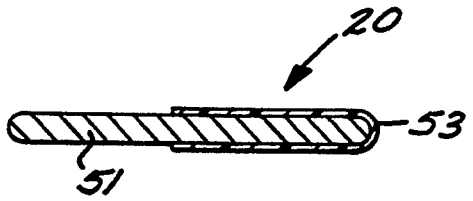
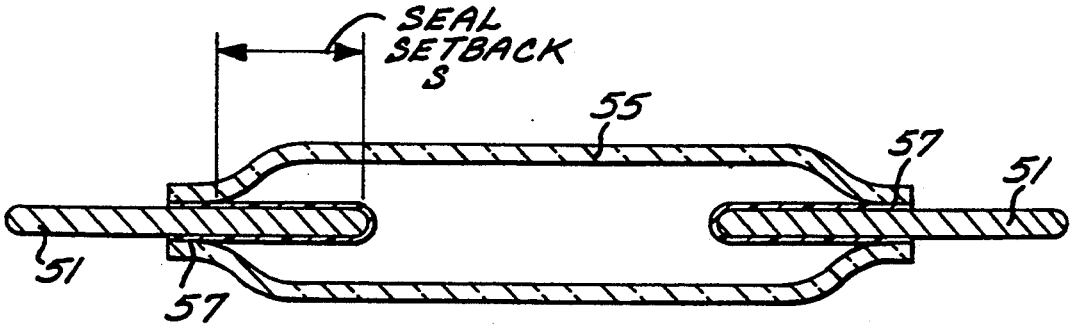
FIG. 4

SHROUDED PIN ELECTRODE STRUCTURE FOR RF EXCITED GAS DISCHARGE LIGHT SOURCES

BACKGROUND OF THE INVENTION

The disclosed invention is directed generally to RF excited gas discharge lights sources, and more particularly to a shrouded pin electrode structure for RF excited gas discharge light sources.

RF gas discharge light sources generally include a gas containment vessel or envelope, and an electrode structure for coupling RF energy into the discharge gas in the containment vessel. The electrode structure is driven by an RF source, and generates a magnetic or electric field that excites the gas molecules. The excited gas molecules emit photons as drop to state(s) with lower energy.

Electrode structures utilized in RF gas discharge light sources commonly comprise pins that are located internal to the gas containment vessel and exposed to the contained gas. The primary energy transfer mechanism involves the acceleration/deceleration of electrons which are thermonically excited off the electrode surface.

Considerations with the use of internal pin electrodes include the use of a glass to metal seal which is susceptible to manufacturing defects, as well as failure and leakage during use, particularly in environments with significant vibration or rapid thermal transitions. Also, electrode material can easily contaminate the discharge gas.

SUMMARY OF THE INVENTION

It would therefore be an advantage to provide an improved internal pin electrode structure for gas discharge light sources having increased reliability.

Another advantage would be to provide an improved internal pin electrode structure for gas discharge light sources that avoids contamination of the discharge gas.

The foregoing and other advantages are provided by the invention in a shrouded pin electrode structure that includes an elongated pin that extends into the volume of a gas containment structure of an RF excited gas discharge light source such that the pin is surrounded by gas along a length thereof, and a gas impermeable dielectric shroud for physically isolating the pin from the gas such that the gas does not contact the pin.

BRIEF DESCRIPTION OF THE DRAWINGS

The advantages and features of the disclosed invention will readily be appreciated by persons skilled in the art from the following detailed description when read in conjunction with the drawing wherein:

FIG. 1 is a schematic illustration of a shrouded pin electrode structure in accordance with the invention.

FIG. 2 is a schematic illustration of an RF gas discharge lamp employing the shrouded pin electrode of FIG. 1.

FIG. 3 is a schematic illustration of a further shrouded pin electrode structure in accordance with the invention.

FIG. 4 is a schematic illustration of an RF gas discharge lamp employing the shrouded pin electrode of FIG. 3.

FIG. 5 sets forth an equivalent circuit of gas discharge lamp implemented with shrouded pin electrodes of the invention.

DETAILED DESCRIPTION OF THE DISCLOSURE

In the following detailed description and in the several figures of the drawing, like elements are identified with like reference numerals.

Referring now to FIG. 1, set forth therein is a shrouded pin electrode structure 10 in accordance with the invention. The electrode structure includes a gas impermeable dielectric shroud 13 comprised of an elongated cylindrical tube 13*a* that is closed at one end and a flange 13*b* surrounding the opening of the elongated cylindrical tube. The shroud 13 is advantageously formed as an integral component, and forms part of a discharge lamp gas containment vessel. As discussed further herein the shroud 13 is made of a gas impermeable dielectric material that is compatible with the other components of the containment vessel with which the electrode structure is to be utilized. A pin electrode 11 extends into the elongated cylindrical tube 13*a* which is of sufficient length to provide a desired gas seal setback S as shown in FIG. 2 which illustrates by way of illustrative example an RF gas discharge lamp that employs the electrode structure 10 of FIG. 1.

The lamp of FIG. 2 includes an optically cylindrical tube 15, comprised for example of glass or quartz, and electrode structures 10 joined to the ends of the tube. The electrode structures 10 are located with the shrouded ends of the electrodes 11 colinearly opposite each other inside the tube 13, and the flanges 13*b* of the electrode structures are joined to the ends of the tube 15 to form gas seals 17 such that the shrouds 13 and the optically transparent cylindrical tube 15 form a containment vessel for containing an appropriate discharge gas.

Referring now to FIG. 3, set forth therein is a shrouded pin electrode structure 20 in accordance with the invention. The electrode structure includes an electrode pin 51 and a gas impermeable dielectric shroud coating 53 disposed over a portion of the pin 51 that includes one end thereof. When the electrode structure is employed in a lamp, as for example shown in FIG. 4, the shroud coating forms part of a gas containment vessel. As discussed further herein, the shroud coating 53 is made of a gas impermeable dielectric material that is compatible with the other components of the containment vessel with which the electrode structure is to be utilized. The shroud coating is of sufficient extent along the length of the electrode pin 51 to provide a desired gas seal setback S shown in FIG. 4.

The lamp of FIG. 4 includes an optically cylindrical tube 55, comprised for example of glass or quartz, having tapered ends and electrode structures 50 sealed to the tapered ends. The electrode structures 50 are located with the coated ends of the electrode pins 51 colinearly opposite each other inside the tube 55, and seal regions of the shroud coating 53 are joined to the taped ends of the tube 55 to form gas seals 17 such that shroud coating 13 and the optically transparent cylindrical tube 55 form a containment vessel for containing an appropriate discharge gas.

Shrouded pin electrodes in accordance with the invention couple RF energy into the discharge gas contained in the containment vessel and more particularly produce a gas discharge causing electric field between the pins pursuant to being charged and discharged by an RF source that includes appropriate matching circuitry, as shown by the equivalent circuit of FIG. 5. The pin electrodes and their shrouds effectively function as capacitances C1 and C2 which are serially connected with the discharge gas contained in the gas discharge lamp, with each shroud acting as the dielectric of the respective capacitor. Because of the small value of the capacitances C1 and C2 produced by the presence of the pin shrouds, the RF frequency is preferably above 50 MHz, and will typically be higher for electrical efficiency as well as gas discharge dynamics. The equivalent circuit of FIG. 5 further includes a shunt capacitance CS which represents the field shunting of the containment vessel and is discussed further herein.

Thus, in accordance with the invention, pin electrodes in an RF excited gas discharge light (radiation) source are physically isolated from the gas in the discharge region that is within a gas containment vessel. The use of pin electrodes can produce an RF excited glow discharge which is similar in character to an arc discharge and is therefore very useful for optical systems where the discharge is imaged. A major advantage of this structure is that it concentrates the discharge causing electric field in the center of the discharge region, minimizing ionized gas/wall interactions. The lack of electrode/gas physical contact prevents contamination of the gas by the electrode material due to erosion, sputtering, or chemical reaction. This is particularly important since the emission performance of the gas or gas mixture is highly dependent upon its composition, purity, and pressure.

The pin electrodes in the electrode structure of the invention may be fabricated from any conductive material with the choice depending upon the specific application. These include both refractory and non-refractory materials. Refractory metals such as tungsten are used where the electrode temperature is sufficiently high to require it. This includes the common case where the discharge radiation source incorporates metal halide salts which must be vaporized in a relatively high pressure environment. Some all gas RF excited discharge light sources can be made to run in modes and with electrode temperatures where non-refractory metals can be used for the actual electrode pins. This provides lower loss due to the typically lower resistivity of these metals.

A variety of materials may be used for the pin shrouds and the other components that form the gas containment vessel of a gas discharge lamp which incorporate shrouded pin electrodes in accordance with the invention. Ideally, the same material would be used for both the shroud and containment vessel since this minimizes compatibility issues and produces the lowest mechanical stresses on the seal. For some specific designs, it may be desirable to use different materials which should be mechanically and thermally compatible over the operating temperature range of the lamp. The use of different materials may be particularly appropriate where the shroud is part of and physically attached to the electrode pin, such as in the shroud coated pin structure discussed below. In this case, high compatibility between the pin and shroud may be much more significant to the realization of a reliable discharge source than using identical materials for the shroud and containment vessel. The material chosen for light transmitting components such as the containment vessel and the flanged shroud must have high transmittance to the desired radiation frequencies generate by the discharge. Since light is not emitted from the electrodes themselves, it is possible to use materials such as ceramic or porcelain as the shroud material. The use of such material may necessitate the use of an interface material between the shroud and the gas containment vessel to compensate for thermal expansion differences. Additionally, the shroud and any interface material should have very low RF power loss at the operating frequency so as to prevent degradation of the efficiency of the lamp and to avoid excessive local heating. The shroud material can comprise a high dielectric constant material which will result in a lower reactive voltage drop across the shroud material without significantly increasing the shunt capacitance effect which is described further herein.

In an RF excited gas discharge source, the dielectric constant of the containment vessel will typically be higher than the gas. This results in the containment vessel (along with the shroud material) shunting the field away from the gas, as represented by the capacitance CS in the equivalent circuit of FIG. 5, and reducing the electrical energy to radiated emission conversion efficiency of the source. This field shunting effect can be minimized by the use of a lower dielectric constant material. An example for a visible light source would be quartz instead of Pyrex glass. The choice remains a tradeoff since quartz is typically a more expensive material and the use of a low dielectric constant material by itself will usually be insufficient to compensate for the field shunting effect. Nevertheless, the gas containment vessel and shroud materials should be selected to have the lowest dielectric constant consistent with the other discharge source requirements.

The effects of field shunting by the containment vessel are compensated by incorporating a seal setback S between the shrouded ends of the electrode pins and the gas seals. The reduction in field shunting increases by increasing the seal setback S. However, since the electrode pin diameter typically should be small to produce high field gradients and the shroud should be kept thin to limited field shunting, the seal setback S cannot be arbitrarily long. The setback affects not only the physical integrity, durability, and long term reliability of the lamp, but can also effect the system optics. An example is the movement of the discharge under vibration conditions.

As discussed above, the electrode pin diameter will be kept relatively small and the shroud material relatively thin. The shroud material should be as thin as practicable consistent with the vibration and thermal operation of the device. In particular, the size and shape of the electrode pins will be a major factor in determining the current density at the tip of the electrode pins and in the discharge. The current density must not be so high as to produce at localized hot spotting and resulting thermal runaway. As a result, the shroud thickness will typically be a significant percentage of the pin diameter, not a thin coating. For all applications, it is essential that the pin, shroud, and gas containment vessel materials and dimensions form a set, the choice of which is also consistent with the electrical, optical, and environmental requirements of the complete system.

The shrouded pin electrode structure in accordance with the invention includes the following significant features: (1) pin electrodes in very close proximity to the gas; (2) lack of physical contact between the electrodes and the gas; (3) gas discharge region sealing by joining identical (or very highly compatible) materials; (4) setback of the end of the discharge region from the end of the pin electrode. The above described embodiments of the shrouded pin electrode structure embody these features, and each has its own considerations as to implementation.

The shroud coating implementation is probably the least costly, and requires a much closer match in the coefficients of thermal expansion of the shroud coating material and the electrode pin material, since shroud coated electrode pins are conveniently joined with the glass tube of the containment vessel by being held in a fixture as they are inserted into the containment vessel tube which is then heated to melt and fuse with the shroud material at the desired gas seal location. A reasonably good match for a visible light source is tungsten for the pin electrode and Pyrex glass for the shroud coating.

The tube and flange shrouded implementation requires reduced thermal and mechanical compatibility between the shroud material and the pin electrode material, since the pin electrode is not part of or attached to the shroud.

The foregoing has been a disclosure of a shrouded pin electrode structure that prevents contamination of the gas by the electrode material due to erosion, sputtering, or chemical reaction, and advantageously concentrates the field in the center of the discharge region, minimizing ionized gas/wall interactions.

Although the foregoing has been a description and illustration of specific embodiments of the invention, various modifications and changes thereto can be made by persons skilled in the art without departing from the scope and spirit of the invention as defined by the following claims.

What is claimed is:

1. An RF excited gas discharge light source comprising:

a cylindrical gas containment tube having first and second ends;

a discharge gas contained within the cylindrical gas containment tube;

first and second pin shaped electrodes respectively located at said first and second ends, said first and second electrodes being colinear and each extending into the volume of said cylindrical gas containment tube so as to be surrounded by said discharge gas along a respective length thereof; and means for physically isolating said first and second pin shaped electrodes from said discharge gas such that said discharge gas does not contact said first and second pin shaped electrodes.

2. The electrode structure of claim 1 wherein said means for physically isolating comprises a gas impermeable dielectric coating disposed over each of said pin shaped electrodes.

3. The electrode structure of claim 2 wherein said gas impermeable dielectric coating comprises glass.

4. The electrode structure of claim 2 wherein said gas impermeable dielectric coating comprises ceramic.

5. The electrode structure of claim 2 wherein said gas impermeable dielectric coating comprises porcelain.

6. The electrode structure of claim 1 wherein said means for physically isolating comprises first and second elongated gas impermeable dielectric tubes extending into the volume of said cylindrical gas containment tube and respectively disposed over said first and second pin shaped electrodes.

7. The electrode structure of claim 1 wherein said cylindrical gas containment tube produces unwanted field shunting and wherein the lengths of said first and second pin shaped electrodes that are surrounded by discharge gas are selected to reduce the field shunting produced by the gas containment structure.

* * * * *